US011399629B2

(12) United States Patent
Rehm

(10) Patent No.: US 11,399,629 B2
(45) Date of Patent: Aug. 2, 2022

(54) DOMESTIC APPLIANCE

(71) Applicant: BSH Hausgeräte GmbH, Munich (DE)

(72) Inventor: Karlheinz Rehm, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/287,543

(22) PCT Filed: Dec. 2, 2019

(86) PCT No.: PCT/EP2019/083286
§ 371 (c)(1),
(2) Date: Apr. 22, 2021

(87) PCT Pub. No.: WO2020/114957
PCT Pub. Date: Jun. 11, 2020

(65) Prior Publication Data

US 2021/0378403 A1 Dec. 9, 2021

(30) Foreign Application Priority Data

Dec. 6, 2018 (DE) ..... 10 2018 221 159.0

(51) Int. Cl.
*A47B 91/02* (2006.01)
*A47L 15/42* (2006.01)
*D06F 39/12* (2006.01)

(52) U.S. Cl.
CPC ..... *A47B 91/028* (2013.01); *A47L 15/4253* (2013.01); *D06F 39/125* (2013.01)

(58) Field of Classification Search
CPC combination set(s) only.
See application file for complete search history.

(56) References Cited

U.S. PATENT DOCUMENTS 1,417,639 A * 5/1922 Sterner ..... A47B 91/028 248/188.4
4,967,994 A * 11/1990 Rice ..... D06F 39/001 248/649

(Continued)

FOREIGN PATENT DOCUMENTS

| | | | |
|---|---|---|---|
| DE | 9112657 | U1 | 1/1992 |
| DE | 19606460 | A1 | 8/1997 |
| WO | 2004107914 | A1 | 12/2004 |

OTHER PUBLICATIONS

National Search Report DE 10 2018 221 159.0 dated Oct. 24, 2019.
International Search Report PCT/EP2019/083286 dated Mar. 5, 2020.

*Primary Examiner* — Monica E Millner
(74) *Attorney, Agent, or Firm* — Michael E. Tschupp; Andre Pallapies; Brandon G. Braun

(57) ABSTRACT

A household appliance includes a housing, height-adjustable levelling feet arranged on an underside of the housing, and height-adjusting devices for adjusting a height of the levelling feet, respectively. Each height-adjusting device includes an adjustment housing fixed to the housing, a threaded shaft passing vertically through the adjustment housing in an interlocking manner and including a foot plate, a worm wheel as an output gear at an outer circumference thereof which is mounted rotatably in the adjustment housing and threadably engaged with the threaded shaft, and a worm connected to an adjusting rod and forming a drive gear for driving the worm wheel. The threaded shaft can have along a length thereof a flattened section which rests against the adjustment housing at one point at least, or two flattened sections arranged on opposite sides of the threaded shaft, or two axially extending grooves arranged on opposite sides of the threaded shaft.

19 Claims, 5 Drawing Sheets

(56) References Cited

U.S. PATENT DOCUMENTS

| | | | | | |
|---|---|---|---|---|---|
| 4,991,805 | A * | 2/1991 | Solak | F16M 7/00 | 248/188.4 |
| 5,292,095 | A * | 3/1994 | Cattaneo | A47B 91/028 | 248/188.4 |
| 5,398,620 | A * | 3/1995 | Rouch | F16M 7/00 | 108/1 |
| 5,967,472 | A * | 10/1999 | Wilhelmstatter | A47L 15/4253 | 248/188.4 |
| 8,220,760 | B2 * | 7/2012 | Fetzer | A47L 15/4253 | 248/188.4 |
| 10,278,500 | B2 * | 5/2019 | De Bruin | A47B 91/024 | |
| 10,638,839 | B2 * | 5/2020 | Cattaneo | A47B 91/028 | |
| 2007/0023590 | A1 * | 2/2007 | Lotz | F16M 7/00 | 248/188.2 |
| 2007/0205342 | A1 * | 9/2007 | Gabriel | F16M 7/00 | 248/188.4 |
| 2017/0314725 | A1 * | 11/2017 | Ozyuksel | F25D 23/00 | |
| 2018/0368574 | A1 * | 12/2018 | Cattaneo | A47B 91/028 | |

* cited by examiner

DOMESTIC APPLIANCE

CROSS-REFERENCES TO RELATED APPLICATIONS

This application is the U.S. National Stage of International Application No. PCT/EP2019/083286, filed Dec. 2, 2019, which designated the United States and has been published as International Publication No. WO 2020/114957 A1 and which claims the priority of German Patent Application, Serial No. 10 2018 221 159.0, filed Dec. 6, 2018, pursuant to 35 U.S.C. 119(a)-(d).

BACKGROUND OF THE INVENTION

The invention relates to a household appliance, in particular a household dishwasher or a household washing machine, with a housing having an underside, wherein a plurality of height-adjustable levelling feet are arranged on the underside of the housing, the height of each height-adjustable levelling foot can be adjusted using the height-adjusting device from a side wall of the household appliance and each height-adjusting device consists of a threaded shaft, which passes vertically through an adjustment housing fixed to the housing and has a foot plate.

In the context of the present description the term "household appliance" essentially means any household appliance that can be provided with a disclosed height-adjusting device. The household appliance is therefore not limited to a household dishwasher or household washing machine but can also be a tumble dryer, a refrigeration appliance, a freezer appliance, a cooker, a microwave appliance, a coffee machine or the like.

It is generally known that integrated kitchen appliances can be adjusted to the correct installation position using height-adjustable appliance feet in the installed state. This involves adjusting the height of the rear appliance feet that are generally inaccessible, usually using an adjusting rod that can be actuated at the front of the appliance.

The publication DE 196 06 460 A1 discloses a height-adjusting device for a levelling foot of a household appliance. The height-adjusting device consists of a threaded shaft, which passes vertically through an adjustment housing fixed to the housing and has a foot plate, a nut mounted rotatably in the adjustment housing being displaced by way of the threaded shaft and being configured as a worm wheel at its outer circumference and being driven by way of a worm connected to an adjusting rod and mounted rotatably in the adjustment housing. The threaded shaft of the height-adjustable levelling foot here passes in an interlocking manner through the adjustment housing.

The publication WO 2004/107914 A1 discloses a height-adjusting device for an appliance foot of a household appliance, wherein a worm wheel meshes with a transmission gear, converting the rotational movement of the worm to a lifting movement of the appliance foot.

The publication WO 2009/068399 A1 discloses a household appliance, in particular a dishwasher or washing machine, with a height-adjusting device for an appliance foot, which has at least one drive gear, which meshes with a transmission gear converting the rotational movement of the drive gear to a lifting movement of the appliance foot. The drive gear is assigned a torque limiting element that allows the drive gear to move out of its operating position when a torque limit is exceeded, releasing the meshing between the drive gear and the transmission gear.

BRIEF SUMMARY OF THE INVENTION

With this in mind, one object of the present invention is to provide an improved household appliance, in particular a household dishwasher or household washing machine.

The inventive object is achieved by the features of the independent claim. Advantageous developments will emerge from the dependent claims.

To achieve the inventive object, a household appliance, in particular a household dishwasher or household washing machine, is proposed, with a housing having an underside, wherein a plurality of height-adjustable levelling feet are arranged on the underside of the housing, the height of each height-adjustable levelling foot can be adjusted using the height-adjusting device from a side wall of the household appliance and each height-adjusting device consists of a threaded shaft, which passes vertically through an adjustment housing fixed to the housing and has a foot plate. A worm wheel mounted rotatably in the adjustment housing and configured as a nut, which is configured as an output gear at its outer circumference and which is driven by way of a worm connected to an adjusting rod, preferably mounted rotatably in the adjustment housing and configured as a drive gear, is displaced by way of the threaded shaft. The threaded shaft of each height-adjustable levelling foot here passes in an interlocking manner through the adjustment housing, with either at least part of the threaded shaft of the height-adjustable levelling foot having at least one flattened section along the length of the threaded shaft, which rests against the adjustment housing at one point at least, the threaded shaft of the height-adjustable levelling foot having two flattened sections and the two flattened sections being arranged on opposite sides of the threaded shaft or the threaded shaft of the height-adjustable levelling foot being provided with two axially extending grooves and the two grooves being arranged on opposite sides of the threaded shaft.

The use of identical or approximately identical height-adjusting devices for all the height-adjustable levelling feet means that tool holders for just one tool, for example a screw driver or Allen key, can be provided to adjust the height of all the height-adjustable levelling feet. The household appliance can therefore be positioned and aligned easily and reliably with just one tool. This allows a household appliance to be positioned more reliably, more quickly and intuitively. It can also be marketed as "perfect built-in".

The interlocking passage of the threaded shaft of the height-adjustable levelling foot through the adjustment housing also readily provides a height-adjusting device for a levelling foot of a household appliance, with which lower outlay reduces costs while maintaining the cited advantages and the height-adjustable levelling foot is not also rotated. With an inventive height-adjusting device the adjustment housing can be much smaller, as it does not have to engage over the threaded shaft.

The height-adjusting device can be used in particular with appliance feet of integrated appliances. The height is then adjusted using an actuation element provided at the front of the household appliance. The actuation element is positioned on an adjusting rod, which extends to the height-adjusting device. The rear end of the adjusting rod can support the worm, for example a drive gear, which in turn meshes with a worm wheel of the transmission gear. The worm wheel is mounted in a fixed position in a bearing housing and has an internal thread that engages with an external thread of the appliance foot shaft. A lifting movement of the appliance foot therefore results when the worm wheel is rotated.

The height-adjusting device can be used in particular for rear appliance feet of integrated appliances. The height-adjusting device allows the inaccessible rear region of the integrated appliance to be raised until the household appliance is at the correct height. When plastic parts in particular are used for the height-adjusting device, there is a risk in the prior art that manual actuation of the height-adjusting device will induce torques, which can result in the destruction of the plastic part.

In a first inventive embodiment provision is made for at least three height-adjustable levelling feet to be arranged on the underside of the housing, with two height-adjustable levelling feet being arranged at the front of the household appliance and at least one height-adjustable levelling foot to be arranged at the rear of the household appliance. This for example allows a further height-adjustable levelling foot to be arranged at the rear of the household appliance in each of the corner regions of the household appliance.

The arrangement of just one height-adjustable levelling foot of three height-adjustable levelling feet with a height-adjusting device that can be operated from a housing side wall reduces the outlay for a household appliance and therefore also the costs. Naturally more than three height-adjustable levelling feet can also be provided in very different arrangements on the household appliance.

In a second inventive embodiment provision is made for the height-adjustable levelling foot arranged at the rear of the household appliance to be arranged approximately in the center of the lower rear housing edge of the household appliance.

The arrangement of the rear height-adjustable levelling foot approximately in the center of the lower rear housing edge results in a bearing layout with an outline of a roughly isosceles triangle, the most stable shape for a three-point bearing layout.

In a further inventive embodiment provision is made for the flattened sections to rest against the adjustment housing at two points at least.

The arrangement of two flattened sections further assists with preventing the height-adjustable levelling foot also rotating during the adjustment operation. The flattened sections are expediently arranged on opposite sides of the threaded shaft, thereby facilitating mounting. The flattened sections advantageously rest against the adjustment housing at two points at least, thereby providing additional security to prevent the height-adjustable levelling foot also rotating.

In a further inventive embodiment provision is made for the flattened sections to extend over the entire length of the threaded shaft.

Because the flattened sections expediently extend over the entire length of the threaded shaft, interlocking passage is ensured over the entire adjustment path. According to a further advantageous embodiment of the invention the threaded shaft of the height-adjustable levelling foot is provided with at least one axially extending groove, which also results in a very simple embodiment of the inventive interlocking passage. The threaded shaft of the height-adjustable levelling foot is preferably provided with two grooves, thereby further assisting with preventing the height-adjustable levelling foot also rotating during the adjustment operation. The grooves are expediently arranged in opposite sides of the threaded shaft, thereby facilitating mounting.

In a further inventive embodiment provision is made for the adjustment housing to have at least one exit opening for the threaded shaft of the height-adjustable levelling foot, its shape being matched to the cross section of the threaded shaft.

Its length means that the threaded shaft not only leaves the adjustment housing at the point opposite the floor but also at a point opposite the foot plate, thereby resulting in an interlocking passage in the manner described above without additional outlay at both these points.

In a further inventive embodiment provision is made for a further height-adjustable levelling foot to be arranged at the rear of the household appliance in each of the corner regions of the household appliance.

This advantageously allows the user to perform a presetting operation with the four height-adjustable levelling feet arranged respectively in the region of the outer, lower housing edges before the household appliance is finally installed in a furniture unit, for example a corresponding recess in a built-in kitchen front, and then if necessary to carry out a final adjustment of the installation position using the height-adjusting device of the fifth height-adjustable levelling foot without having to move the household appliance in and out again or even repeatedly. The household appliance can optionally be positioned on four or three height-adjustable levelling feet in the process. If the presetting should also be correct for the final installation site, the household appliance remains set up on four height-adjustable levelling feet but if the presetting subsequently has to be changed using the fifth height-adjustable levelling foot, a three-point bearing layout results. The arrangement of the fifth height-adjustable levelling foot approximately in the center of the lower rear housing edge means that, when the fifth foot is deployed, a bearing layout with the outline of a roughly isosceles triangle results, the most stable shape for a three-point bearing layout.

In a further inventive embodiment provision is made for the worm to be assigned a torque limiting element that allows the worm to move out of its operating position when a torque limit is exceeded, releasing the meshing between the worm and the worm wheel.

This at least temporarily releases the meshing between the worm and a transmission gear element meshing with it. The outward movement allows the worm to skip at least one thread pitch in relation to the transmission gear element thereby disengaging the teeth of the worm and the transmission gear element.

The outward movement of the worm can therefore take place when a permissible maximum torque is exceeded. The permissible maximum torque should be determined based on the structural design of the torque limiting element and as a function of its material strength. The permissible maximum torque here should be such that the worm, the transmission gear and/or a shaft or adjusting rod driving the worm are not damaged. With the inventive torque limiting element, as with a slip clutch, the worm is temporarily unmeshed when the maximum torque is exceeded, so that it rotates freely and no torque is transferred to the transmission gear. When the induced torque drops below the torque limit, the worm meshes with the transmission gear again.

The torque limiting element does not only allow reliable torque limiting when the appliance foot shaft of the height-adjusting device moves against an end stop, as is the case in the prior art. Rather the invention ensures that torque limiting takes place over the entire adjustment region of the appliance foot shaft.

As mentioned above, the height-adjusting device can be used in particular for rear appliance feet of integrated appliances. When plastic parts in particular are used for the height-adjusting device, there is a risk here in the prior art that manual actuation of the height-adjusting device will induce torques, which can result in the destruction of the plastic part.

In a further inventive embodiment provision is made for the worm to be pushed against the torque limiting element with a deflection force that results during torque transmission.

If the deflection force is too great, the torque limiting element ideally yields in an elastic manner, with the result that the worm moves out. This causes the worm to skip the teeth of the worm wheel, whereupon the elastically returning torque limiting element moves the worm back to mesh with the worm wheel. Such skipping of the teeth can be perceived as a rattling noise so the user realizes that the household appliance has come up against a stop, for example an upper kitchen worktop.

In a further inventive embodiment provision is made for the torque limiting element to be elastically deflectable.

The worm is preferably configured so that when torque is transmitted to the transmission gear, a deflection force is generated between the worm and the worm wheel of the transmission gear, pushing the worm against the torque limiting element. The limiting element here can be configured to be elastically deflectable. The above-mentioned deflection force is generated by correspondingly angled teeth of the worm and/or worm wheel.

In a further inventive embodiment provision is made for the torque limiting element to be a housing part of the adjustment housing, in which the worm is rotatably mounted, or for the torque limiting element to be of the same material and/or of a single piece with a base support floor of the base support of the household appliance, the base support floor of the base support preferably being an injection-molded plastic part together with the torque limiting element.

It is simple for manufacturing purposes, if the torque limiting element is a housing part of the adjustment housing, in which the worm is rotatably mounted, or if the torque limiting element is of the same material and/or of a single piece with a base support floor of the base support of the household appliance. The base support floor of the base support serves to support appliance units. It can be manufactured as an injection-molded plastic part together with the torque limiting element. The compensatory movement of the worm can then take place across the rotation axis of the worm wheel.

In a further inventive embodiment provision is made for the torque limiting element to be able to be brought into contact with the toothed wheel outer contour of the worm.

Alternatively the torque limiting element can be brought into contact with a shaft driving the worm. It is preferable for a compact configuration of the height-adjusting device if the torque limiting element can be brought directly into contact with the toothed wheel outer contour of the worm.

In a further inventive embodiment provision is made for the worm to mesh with the worm wheel and in particular for the rotation axis of the worm to be perpendicular to the rotation axis of the worm wheel.

In a further inventive embodiment provision is made for the compensatory movement of the worm to be directed across the rotation axis of the worm wheel.

It is simple for manufacturing purposes, if the torque limiting element is of the same material and/or of a single piece with a base support floor of the base support of the household appliance. The base support floor of the base support serves to support appliance units. It can be manufactured as an injection-molded plastic part together with the torque limiting element. The compensatory movement of the worm can then take place across the rotation axis of the worm wheel.

In a further inventive embodiment provision is made for the torque limiting element to be a sprung rib.

Such a sprung rib has a projecting and free end, which can easily be configured to be elastically deflectable with little force outlay during manufacture.

BRIEF DESCRIPTION OF THE DRAWINGS

Further advantageous configurations and aspects of the household appliance are set out in the subclaims and the exemplary embodiments of the household appliance described in the following. The household appliance is also described in more detail based on preferred embodiments with reference to the accompanying figures.

DETAILED DESCRIPTION OF EXEMPLARY EMBODIMENTS OF THE PRESENT INVENTION

Figure 1:
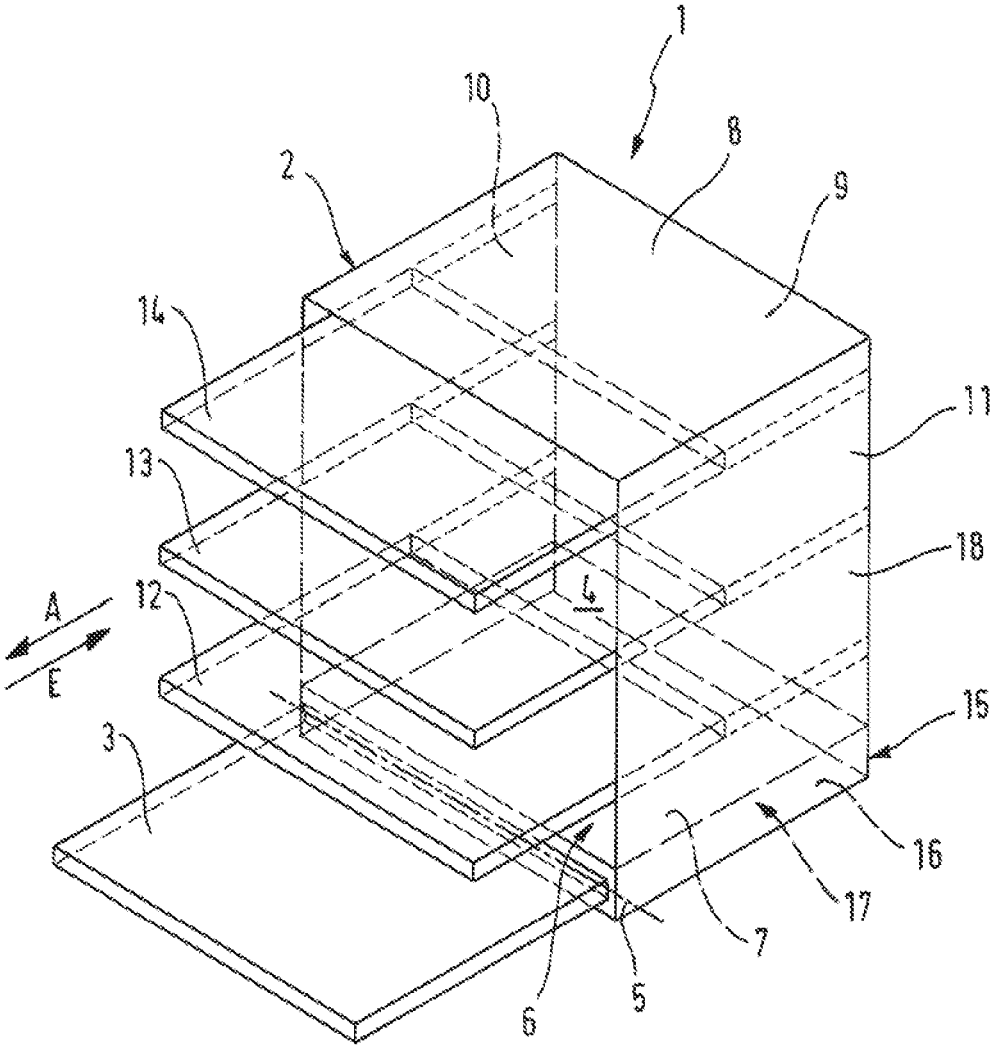
FIG. 1 shows a schematic perspective view of an embodiment of a known household appliance, in particular a known household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a wash container 2, which can be closed, in particular in a water-tight manner, by a door 3. A sealing facility can be provided between the door and the wash container 2 for this purpose. The wash container 2 is preferably cuboid in shape. The wash container 2 can be arranged in a housing of the household dishwasher 1. The wash container 2 and the door 3 can form a wash chamber 4 for washing items to be washed.

In FIG. 1 the door 3 is shown in its opened position. The door 3 can be closed or opened by pivoting about a pivot axis 5 provided at a lower end of the door 3. A loading opening 6 of the wash container 2 can be closed or opened with the aid of the door 3. The wash container 2 has a floor 7, a top 8 arranged opposite the floor 7, a rear wall 9 arranged opposite the closed door 3 and two side walls 10, 11 arranged opposite one another. The floor 7, top 8, rear wall 9 and side walls 10, 11 can be made of stainless steel for example. Alternatively the floor 7 for example can be made of a plastic material.

The household dishwasher 1 also has at least one dish receptacle 12 to 14. Multiple, for example three, dish receptacles 12 to 14 can preferably be provided, it being possible for the dish receptacle 12 to be a lower dish receptacle or a lower rack, the dish receptacle 13 to be an upper dish receptacle or an upper rack and the dish receptacle 14 to be a flatware drawer. As shown in FIG. 1, the dish receptacles 12 to 14 are arranged one above the other in the wash container 2. Each dish receptacle 12 to 14 can be moved as required into or out of the wash container 2. In particular each dish receptacle 12 to 14 can be moved into the wash container 2 in an insertion direction E (arrow) and out of the wash container 2 in a pull-out direction A (arrow) counter to the insertion direction E (arrow). The lower dish receptacle 12 can also be raised using a lifting facility (to be described below) from an initial position to an end position, in which it is preferably arranged in front of the upper dish receptacle 13 and at the same height as it.

The wash container 2 of the household dishwasher 1 is positioned on a base support 15, with a technical space 17 for holding mechanical and/or electrical components of the household dishwasher 1 arranged between the base support floor 16 configured on the base support 15 and the wash container 2. The household dishwasher generally comprises a housing 18, which is provided on the underside 18.U (see FIG. 2) with in particular height-adjustable levelling feet 19, 19', 19" (see FIG. 2). The underside 18.U (see FIG. 2) of the housing is in particular the underside of the base support floor 16 of the base support 15.

Figure 2:
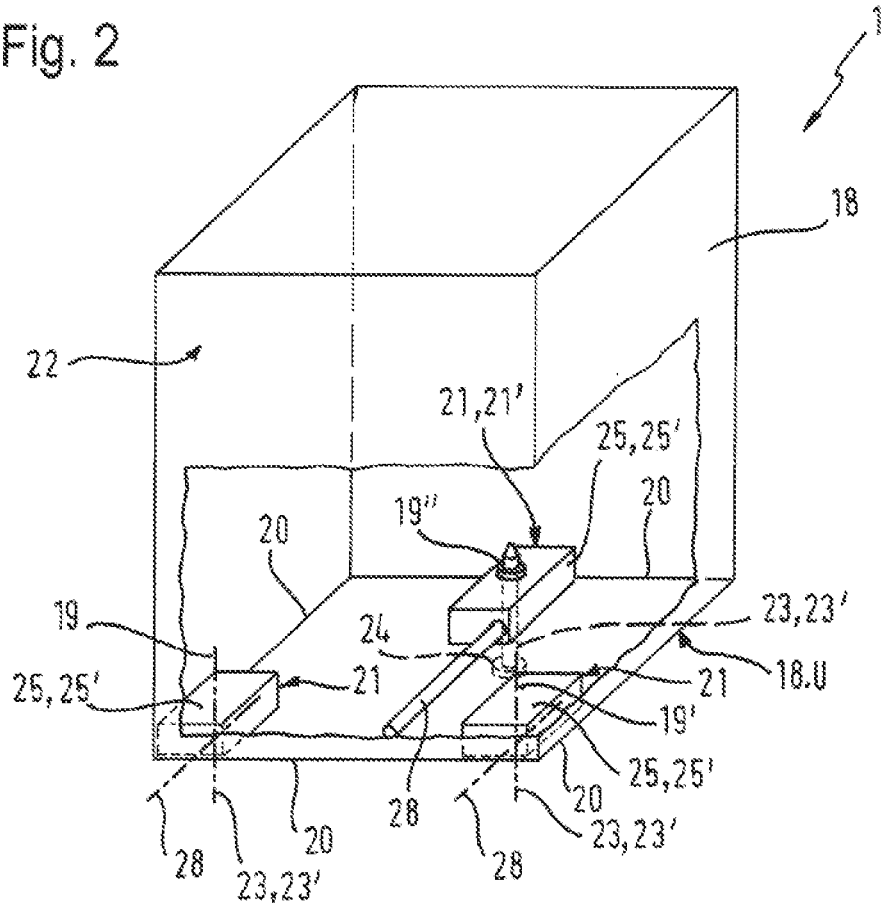
FIG. 2 shows a schematic perspective view of a first preferred embodiment of an inventive household appliance with height-adjusting devices for a respective height-adjustable levelling foot.

FIG. 2 shows a schematic perspective view of a first preferred embodiment of an inventive household appliance 1 with height-adjusting devices 21, 21' for a respective height-adjustable levelling foot 19, 19', 19".

The household appliance 1 comprises a housing 18, which in the exemplary embodiment shown is provided on the underside 18.U with three height-adjustable levelling feet 19, 19', 19". The height of each of the height-adjustable levelling feet 19 (front; shown with a broken line), 19' (front; shown with a broken line), 19" (rear) can be adjusted. The three height-adjustable levelling feet 19, 19', 19" are each arranged in the region of the outer, lower housing edges 20. The height-adjustable levelling foot 19" arranged at the rear of the household appliance 1 is arranged approximately in the center of the lower rear housing edge 20 of the household appliance 1.

The height of each of the three height-adjustable levelling feet 19, 19', 19" can be adjusted using a height-adjusting device 21, 21', from the front 22 of the household appliance 1 in the exemplary embodiment shown. Each height-adjustable levelling foot 19, 19', 19" comprises a threaded shaft 23, 23' (shown at the front with a broken line) and a foot plate 24 (see also FIGS. 3, 4 and 9) fixed thereto.

The respective threaded shaft 23, 23' of the height-adjustable levelling feet 19, 19', 19" passes vertically through an adjustment housing 25, 25' of the height-adjusting device 21, 21' fixed to the housing. A worm wheel 26 (see also FIGS. 3 to 6 and 9) mounted rotatably in the respective adjustment housing 25, 25' and configured as a nut, which is configured as an output gear at its outer circumference and which is driven by way of a worm 27 (see also FIGS. 4 and 9) connected to an adjusting rod 28 (shown at the front with a broken line; see also FIG. 4) and mounted rotatably in the adjustment housing 25, 25', is displaced by way of the threaded shaft 23, 23'.

The respective adjusting rod 28 (see also FIG. 4) passes through the housing 18 of the household appliance 1 in a manner not explained in detail and extends to the front 22 of the household appliance 1, where it has for example a slit for a screwdriver, a polygon for an open-jaw wrench or the like for the user to operate the inventive height-adjusting device 21, 21'.

The respective threaded shaft 23, 23' of the height-adjustable levelling foot 19, 19', 19" passes in an interlocking manner through the adjustment housing 25, 25' to prevent the height-adjustable levelling foot 19, 19', 19" also rotating during the adjustment operation.

Figure 3:
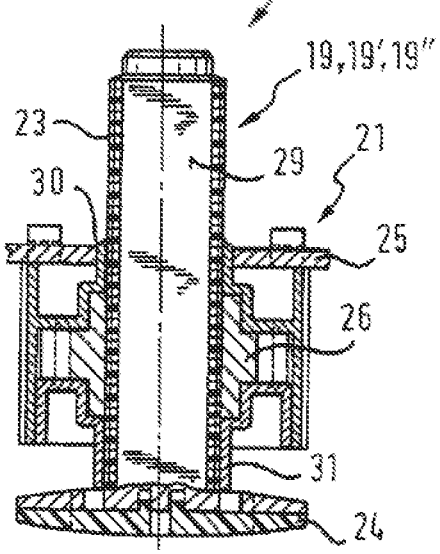
FIG. 3 shows a detail of a side view through an adjustment housing of the height-adjusting device for a height-adjustable levelling foot of an inventive household appliance.
Figure 4:
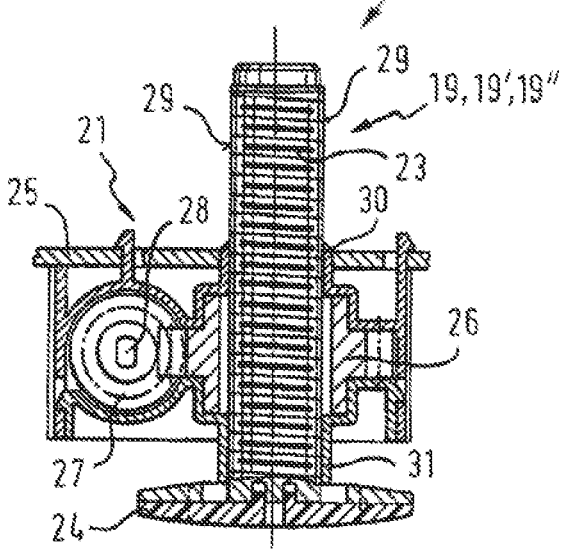
FIG. 4 shows a detail of a front view through an adjustment housing of the height-adjusting device for a height-adjustable levelling foot of an inventive household appliance.

FIGS. 3 and 4 show two views, a side view and a front view, through an adjustment housing 25 of the height-adjusting device 21 for a height-adjustable levelling foot 19, 19', 19" of a first embodiment of an inventive household appliance 1.

So that the threaded shaft 23 of the height-adjustable levelling foot 19, 19', 19" can pass in an interlocking manner, the threaded shaft 23 (see also FIG. 5) has two flattened sections 29 (see also FIG. 5) arranged on opposite sides, which rest against the adjustment housing 25 at two points, specifically an upper exit opening 30 (see also FIG. 5) and a lower exit opening 31 (see also FIG. 5), which are configured with a shape matched to the cross section of the threaded shaft 23 to achieved interlocking passage. The matching of the shape of the exit openings 30, 31 (see also FIG. 5) to the cross-sectional shape of the threaded shaft 23 is achieved by cutting out the circular shape of the exit openings 30, 31 (see also FIG. 5) using opposing cutouts 32 (see also FIG. 5) with straight chords. This is shown most clearly in FIG. 4. The flattened sections 29 extend over the entire length of the threaded shaft 23.

Figure 5:
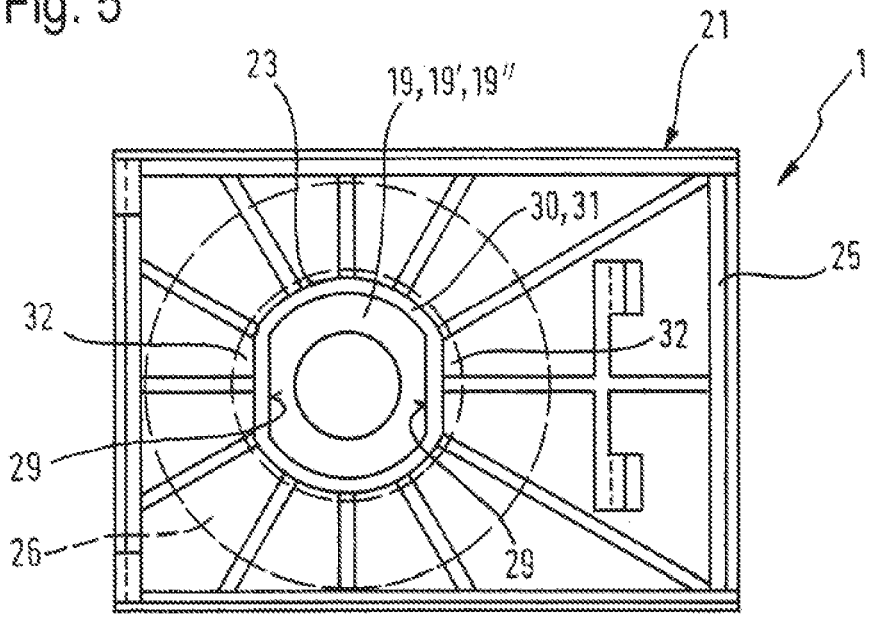
FIG. 5 shows a top view of the height-adjusting device for a height-adjustable levelling foot of an inventive household appliance according to a first preferred embodiment.

FIG. 5 shows a top view of the height-adjusting device 21 for a height-adjustable levelling foot 19, 19', 19" of the inventive household appliance 1 according to FIGS. 3 and 4, arranged in an adjustment housing 25.

Figure 6:
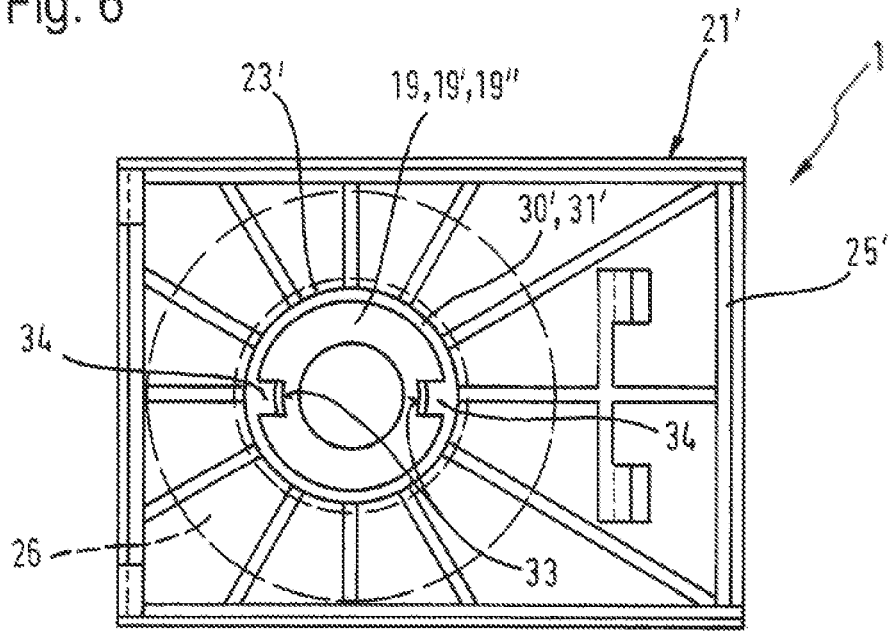
FIG. 6 shows a top view of the height-adjusting device for a height-adjustable levelling foot of an inventive household appliance according to a second preferred embodiment.

FIG. 6 shows a top view of the height-adjusting device 21' for a height-adjustable levelling foot 19, 19', 19" of a second embodiment of an inventive household appliance 1, arranged in an adjustment housing 25'.

So that the threaded shaft 23' of the height-adjustable levelling foot 19, 19', 19" can pass in an interlocking manner, the threaded shaft 23' has grooves 33 arranged on opposite sides, into which noses 34 project respectively from the upper exit opening 30' and also from the lower exit opening 31' (not shown) in the direction of the threaded shaft 23'.

The interlocking passage of the threaded shaft 23' of the respective height-adjustable levelling foot 19, 19', 19" through the adjustment housing 25' provides a height-adjusting device 21' for a height-adjustable levelling foot 19, 19', 19" of a household appliance 1 in a simple manner, its lower outlay reducing costs, it being able to be operated from a housing side wall, preferably the front 22 (see also FIG. 2) of the household appliance 1 and not causing the height-adjustable levelling foot 19, 19', 19" also to be rotated.

Figure 7:
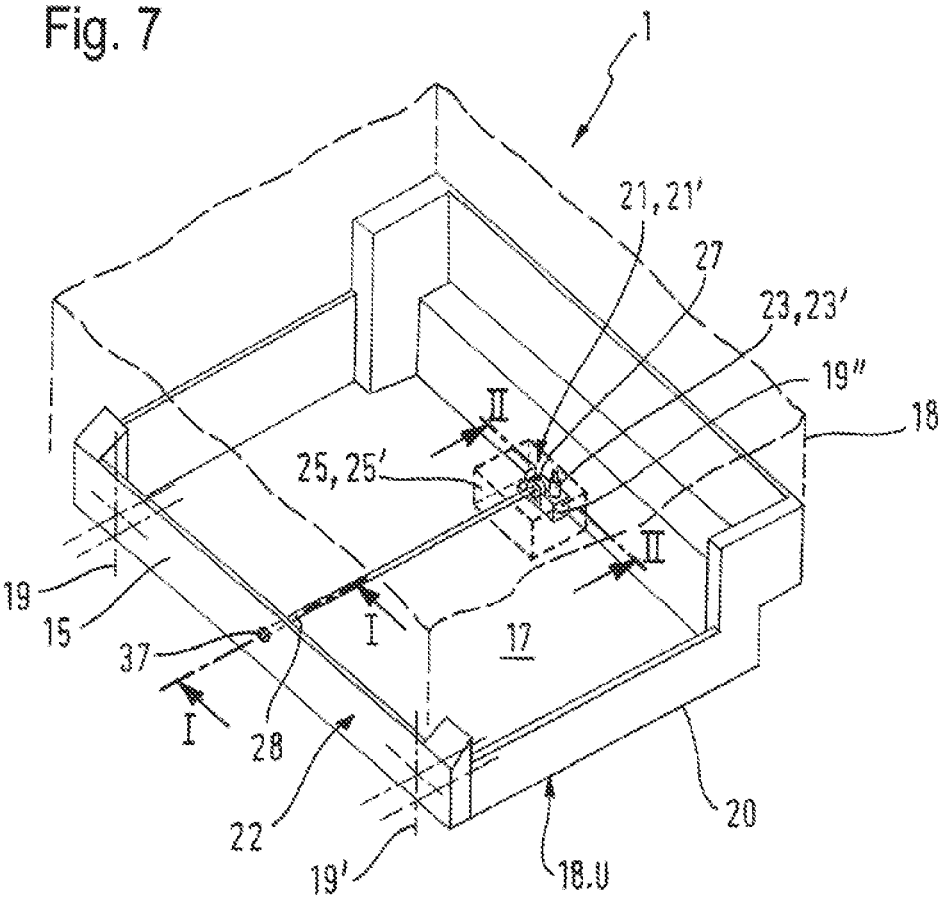
FIG. 7 shows a schematic perspective partial view of a second preferred embodiment of an inventive household appliance with height-adjusting devices for a respective height-adjustable levelling foot.

FIG. 7 shows a schematic perspective partial view of a second preferred embodiment of an inventive household appliance 1 with height-adjusting devices 21, 21' for a respective height-adjustable levelling foot 19, 19', 19".

FIG. 7 shows a base support 15, manufactured as an injection-molded plastic part, of the simply indicated household appliance 1, which comprises a housing 18. The appliance units provided in a technical space 17 of the household appliance 1, which has a front 22, are omitted for reasons of clarity. In the exemplary embodiment shown the housing 18 is provided on its underside 18.U with three height-adjustable levelling feet 19, 19', 19". The height of each of the levelling feet 19 (front; shown with a broken line), 19' (front; shown with a broken line), 19" (rear) can be adjusted. The three height-adjustable levelling feet 19, 19', 19" are each arranged in the region of the outer, lower housing edges 20 (see also FIG. 2). The height-adjustable levelling foot 19" arranged at the rear of the household appliance 1 is arranged approximately at the center of the lower rear housing edge 20 of the household appliance 1.

The height of each of the three height-adjustable levelling feet 19, 19', 19" can be adjusted from the front 22 of the household appliance 1 using a height-adjusting device 21, 21' in the exemplary embodiment shown. Each height-adjustable levelling foot 19, 19', 19" can be embodied in the same manner as the height-adjustable levelling foot 19, 19', 19" disclosed in FIGS. 2 to 6.

The respective threaded shaft 23, 23' of the height-adjustable levelling feet 19, 19', 19" can pass vertically through an adjustment housing 25, 25' (only the height-adjustable levelling foot 19" shown with a broken line) of the height-adjusting device 21, 21' fixed to the housing.

Figure 8:
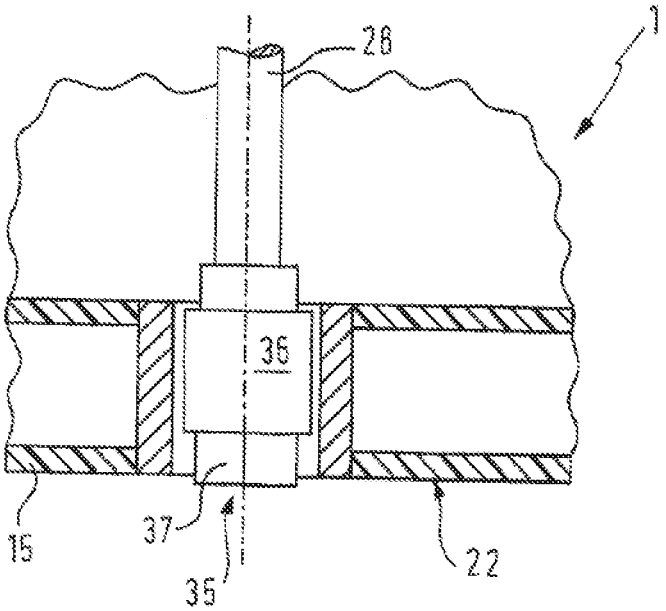
FIG. 8 shows an enlarged sectional view from above of a front actuation element of a height-adjusting device along the sectional plane I-I in FIG. 7.

FIG. 8 shows an enlarged sectional view from above of a front actuation element 35 of a height-adjusting device 21, 21' (see FIG. 7) of the inventive household appliance 1 along the sectional plane I-I in FIG. 7.

The height-adjusting device 21, 21' (see also FIG. 7) is assigned an adjusting rod 28 (see also FIG. 7), which extends to the front 22 of the base support 15 in the manner of a drive shaft. The front end of the adjusting rod 28 has an adjusting bush 36, which is mounted rotatably in a bearing opening of the front 22, which is twin-walled here, of the base support 15. The front of the adjusting bush 36 of the adjusting rod 28 is provided with a tool holder 37 (see also FIG. 7) for just one tool, for example a screwdriver, open-jaw wrench, ring wrench or Allen key, to adjust the height of all the height-adjustable levelling feet, which can be used to actuate the adjusting rod 28 rotationally. The rear end of the adjusting rod 28 is connected for drive purposes, as disclosed above, to the height-adjusting device 21, 21'.

Figure 9:
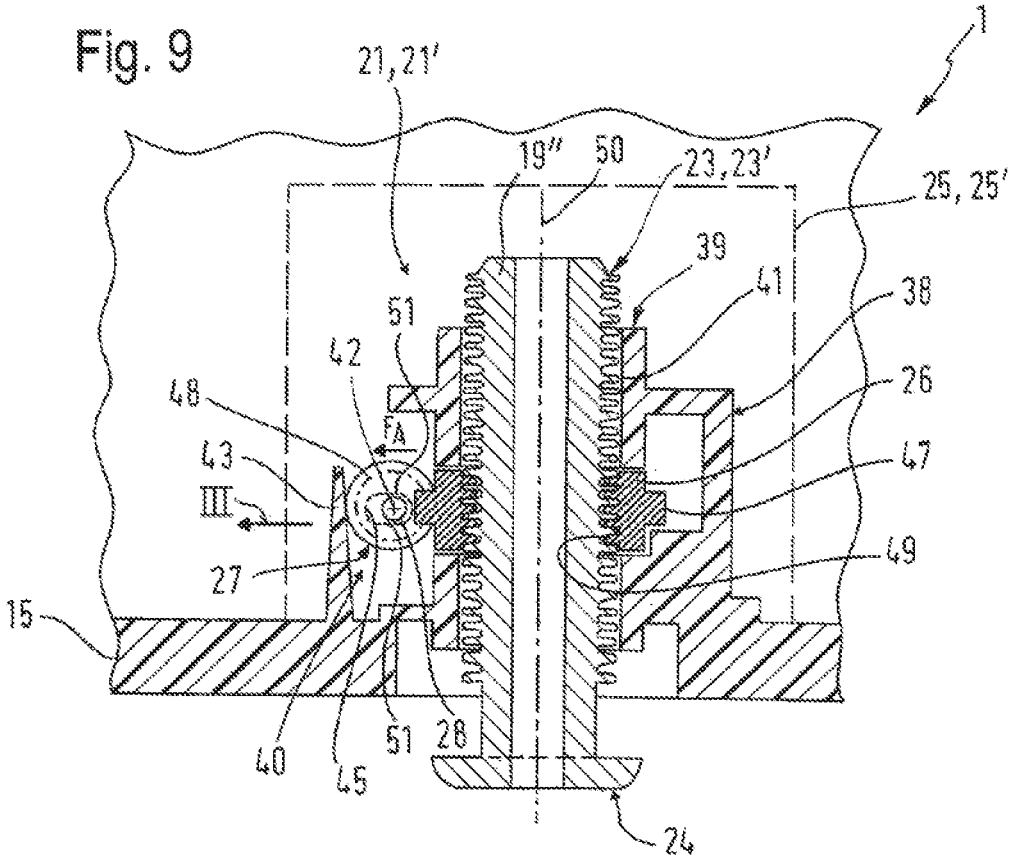
FIG. 9 shows an enlarged partial sectional view of a height-adjusting device along the sectional plane II-II in FIG. 7.

FIG. 9 shows an enlarged partial view of the height-adjusting device 21, 21' of the inventive household appliance 1 arranged in an adjustment housing 25, 25' along the sectional plane II-II in FIG. 7.

The respective height-adjusting device 21, 21' has a gear housing 38, which is preferably molded as a single piece on the base support 15. The gear housing 38 is subdivided into a substantially hollow cylindrical shaft housing 39 and a worm housing 40. A threaded shaft 23 23' of the height-adjustable levelling foot 19" is arranged in the shaft housing 39 in a height-adjustable and rotationally fixed manner. For a rotationally fixed arrangement the threaded shaft 23, 23' has a flattened section 29 (see also FIG. 10) in the external thread of the threaded shaft 23, 23'. The shaft channel 41 of the shaft housing 39 is also flattened to correspond to this flattened section 29, so the threaded shaft 23, 23' can only move in a vertical direction not in a rotational direction.

The shaft channel 41 of the shaft housing 39 is also divided into two in a vertical direction. The worm wheel 26 is arranged between the two channel sections, with a screw-type connection to the threaded shaft 23, 23'.

As shown in the figures, the rotation axis 42 of the worm 27 (see also FIG. 7) extends horizontally in a depthwise direction, while the rotation axis 50 of the threaded shaft 23, 23' runs perpendicular thereto.

The worm housing 40 (see also FIG. 10) is limited laterally by a torque limiting element 43. The torque limiting element 43 here is a sprung rib, which is molded onto the base support 15 with a freely movable upper end. When the height-adjusting device 21, 21' is in a non-actuated state in an operating position the worm 27 is arranged substantially without play between the sprung rib 43 of the worm housing part 40 and the worm 27. FIG. 9 only shows the adjustment housing 23, 23' of the height-adjusting device 21, 21' with a broken line.

Figure 10:
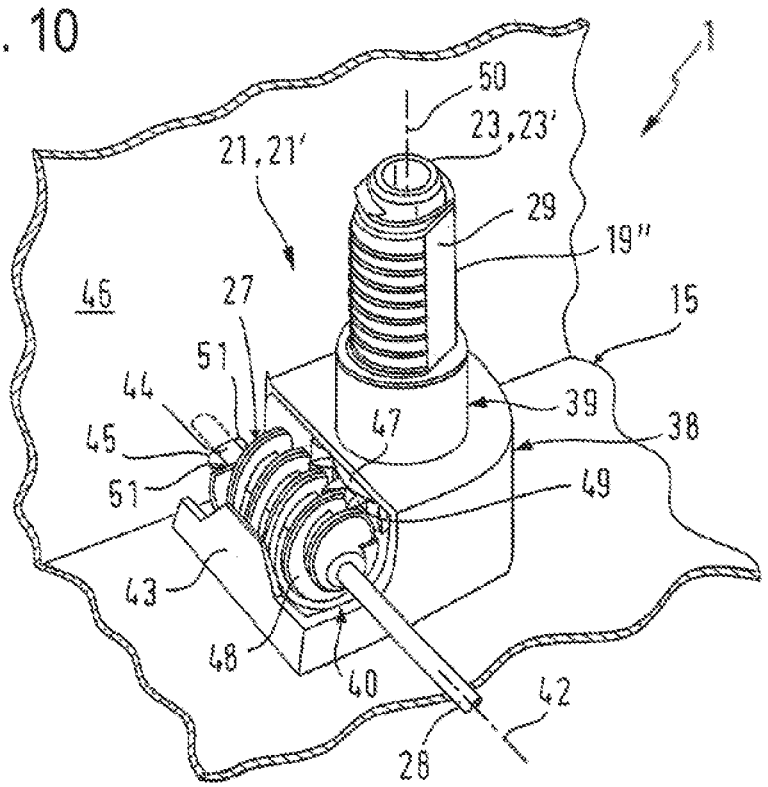
FIG. 10 shows a perspective detailed view of a height-adjusting device of an inventive household appliance.

FIG. 10 shows a perspective detailed view of a height-adjusting device 21, 21' of an inventive household appliance 1.

The worm 27 is extended with a bearing pin 44, which is mounted rotatably in a slot 45 in the rear wall 46 of the base support 15. A worm wheel 26 (see also FIG. 9) is connected between the worm 27 and the threaded shaft 23, 23' of the height-adjustable levelling foot 19". The external gears 47 of the worm wheel 26 mesh with the helical screw 48 of the worm 27. The worm wheel 26 also has an internal thread 49 on the inside, which engages with the external thread of the threaded shaft 23, 23'. The adjustment housing of the height-adjusting device 21, 21' is not shown in FIG. 10 for the sake of clarity.

FIGS. 9 and 10 show the normal operating position of the height-adjusting device 21, 21' of the inventive household appliance 1.

The worm 23 therefore meshes with the worm wheel 26. When the adjusting rod 28 is actuated rotationally, the worm wheel 26 is therefore rotated by way of the worm 23, resulting in a lifting movement of the height-adjustable levelling foot 19" in a vertical direction.

Torque is limited by the sprung rib 43, when a torque acting on the height-adjusting device 21, 21' exceeds a torque limit.

Such an overload, which is not part of normal operation, results when the rear appliance region comes up against a kitchen worktop for example due to a height adjustment of the rear height-adjustable levelling foot 19", so that no further lifting movement of the integrated appliance is possible. When the torque limit is exceeded, a deflection force $F_A$ (arrow) results between the helical screw 48 and the external gears 47 of the worm wheel 26, pushing the worm 23 against the sprung rib 43 in a transverse direction. In the case of an overload the sprung rib 43 yields elastically so the worm 23 moves out (arrow III) of its operating position. This means that the helical screw 48 skips a thread pitch of the external gears 47 of the worm wheel 26. Such a skip is perceived as a rattling noise allowing a corresponding lifting actuation of the rear height-adjustable levelling foot 19" to be stopped.

As shown in particular in FIG. 10, the compensatory movement (arrow III) of the worm 23 takes place in a transverse direction relative to the rotation axis 42 of the worm wheel 26. The slot 45, in which the bearing pin 44 of the worm 23, 23' is mounted, also extends in the transverse direction. The upper and lower longitudinal edges 51 (see also FIG. 9) of the slot 45 serve here as a heightwise stop, allowing the outward movement (arrow III) of the worm 23 to be performed reliably in the direction of the sprung rib 43.

When installing the household appliance 1 the user uses the three height-adjustable levelling feet 19, 19', 19" arranged in the region of the outer, lower housing edges 20 (see also FIG. 2) to perform a presetting operation before the household appliance 1 is finally installed for example in a furniture unit, for example a corresponding recess in a built-in kitchen front. The household appliance 1 is then moved to its final installation site, for example by pushing it into the recess. The user now checks the installation position of the household appliance 1 and if necessary carries out a final adjustment of the installation position using the height-adjusting device 21, 21' of the rear height-adjustable levelling foot 19" without having to move the household appliance in and out again or even repeatedly. The household appliance 1 can optionally be positioned on five, four or three height-adjustable levelling feet in the process. If the presetting should also be correct for the final installation site, the household appliance remains installed on the height-adjustable levelling feet 19, 19', 19", in other words a three-point bearing layout. As the rear height-adjustable levelling foot 19" is approximately in the center of the lower rear housing edge 20, there is then a bearing layout with the outline of a roughly isosceles triangle, the most stable shape for a three-point bearing layout Although the present invention has been described based on exemplary embodiments, it can be modified in many different ways.

The invention claimed is:

1. A household appliance, comprising:

a housing having an underside;

a plurality of height-adjustable levelling feet arranged on the underside of the housing, wherein at least one height-adjustable levelling foot of the plurality of height-adjustable levelling feet is positioned at a rear of the underside and at least two other height-adjustable levelling feet of the plurality of height-adjustable levelling feet are positioned at a front of the underside; and a plurality of height-adjusting devices configured to adjust a height of the plurality of height-adjustable levelling feet in one-to-one correspondence from a side wall of the household appliance, wherein at least one height-adjusting device of the plurality of height-adjusting devices is positioned at the rear of the household appliance and approximately at a center between rear corners of the household appliance, the at least one height-adjusting device corresponding to the at least one height-adjustable levelling foot, and wherein at least two height-adjusting devices of the plurality of height-adjusting devices are positioned at the front of the household appliance, the at least one height-adjusting device corresponding to the at least two other height-adjustable levelling feet, wherein each height-adjusting devices of the plurality of height-adjusting devices comprising:

an adjustment housing fixed to the housing;

a threaded shaft passing vertically through the adjustment housing in an interlocking manner and including a foot plate;

a worm wheel mounted rotatably in the adjustment housing and threadably engaged with the threaded shaft, the worm wheel configured as a nut and configured as an output gear at an outer circumference of the worm wheel;

an adjusting rod; and a worm, which is connected to the adjusting rod and configured as a drive gear for driving the worm wheel; and wherein the threaded shaft is configured in one of:

a first way in which the threaded shaft has along a length of the threaded shaft a flattened section which rests against the adjustment housing at one point at least;

a second way in which the threaded shaft has two flattened sections arranged on opposite sides of the threaded shaft; or a third way in which the threaded shaft has two axially extending grooves arranged on opposite sides of the threaded shaft.

2. The household appliance of claim 1, constructed in the form of a household dishwasher or household washing machine.

3. The household appliance of claim 1, wherein the worm is mounted rotatably in the adjustment housing.

4. The household appliance of claim 1, wherein two of the plurality of height-adjustable levelling feet are arranged at the front of the housing and one of the plurality of height-adjustable levelling feet is arranged at the rear of the housing.

5. The household appliance of claim 4, wherein the housing has a lower rear housing edge, said one of the plurality of height-adjustable levelling feet being arranged approximately in the center of the lower rear housing edge.

6. The household appliance of claim 1, wherein the flattened sections of the threaded shaft rest against the adjustment housing at two points at least.

7. The household appliance of claim 1, wherein the flattened sections extend over an entire length of the threaded shaft.

8. The household appliance of claim 1, wherein the adjustment housing has an exit opening for the threaded shaft of the height-adjustable levelling foot, said exit opening have a shape which matches a cross section of the threaded shaft.

9. The household appliance of claim 1, further comprising a torque limiting element interacting with the worm and configured to allow the worm to move out of an operating position when a torque limit is exceeded, thereby releasing a meshing between the worm and the worm wheel.

10. The household appliance of claim 9, wherein the worm is pushed against the torque limiting element with a deflection force that results during torque transmission.

11. The household appliance of claim 9, wherein the torque limiting element is configured for elastic deflection.

12. The household appliance of claim 9, wherein the torque limiting element is a housing part of the adjustment housing.

13. The household appliance of claim 9, further comprising a base support including a base support floor, said torque limiting element being of a same material as the base support floor and/or of a single piece with the base support floor.

14. The household appliance of claim 13, wherein the base support floor of the base support and the torque limiting element form together an injection-molded plastic part.

15. The household appliance of claim 9, wherein the torque limiting element is configured for contacting an outer gear contour of the worm.

16. The household appliance of claim 1, wherein the worm meshes with the worm wheel and is mounted for rotation about a rotation axis which is perpendicular to a rotation axis of the worm wheel.

17. The household appliance of claim 16, wherein the worm executes a compensatory movement which is directed across the rotation axis of the worm wheel.

18. The household appliance of claim 9, wherein the torque limiting element is a sprung rib.

19. The household appliance of claim 1, wherein the at least two height-adjusting devices are the same or substantially the same as the at least one height-adjusting device, wherein each height-adjusting device of the plurality of height-adjusting devices includes a tool holder sized to receive a common tool as other height-adjusting devices of the plurality of height-adjusting devices.

* * * * *